United States Patent [19]

Rampolla et al.

[11] 4,153,224

[45] May 8, 1979

[54] LASER COMMAND GUIDANCE SYSTEM

[75] Inventors: Robert W. Rampolla; Brewton O. Van Hook, both of Ellicott City, Md.

[73] Assignee: Westinghouse Electric Corp., Pittsburgh, Pa.

[21] Appl. No.: 654,304

[22] Filed: Jan. 29, 1976

[51] Int. Cl.[2] ..... F41G 7/12; F41G 7/00; F42B 15/02

[52] U.S. Cl. ..... 244/3.16; 244/3.14; 244/3.19

[58] Field of Search ..... 244/3.14, 3.16, 3.15, 244/3.19

[56] References Cited

U.S. PATENT DOCUMENTS

| | | | |
|---|---|---|---|
| 3,848,830 | 11/1974 | Born | 244/3.16 |
| 3,876,308 | 4/1975 | Alpers | 244/3.16 |
| 3,946,384 | 3/1976 | Westaway | 244/3.14 |

*Primary Examiner*—Verlin R. Pendegrass
*Assistant Examiner*—Thomas H. Webb
*Attorney, Agent, or Firm*—H. W. Patterson

[57] ABSTRACT

A guidance system is provided for flight vehicles which establishes a reference direction in space by means of two pulsed laser beams. The desired direction is remotely determined and an optical tracker on the flight vehicle is then gated ON by a first pulsed laser beam wih a fixed time delay following receipt of a pulse on board the vehicle. A second pulsed laser beam is fired in a direction to intersect the desired flight path at a set distance from the vehicle, and at a time such that a pulse of the second beam crosses the desired path, and returns to the missile during the time while the tracker on the vehicle is gated ON, so that the tracker receives energy from the backscatter from the atmospheric segment illuminated by the pulse, and causes the vehicle to travel in the desired direction.

3 Claims, 4 Drawing Figures

LASER COMMAND GUIDANCE SYSTEM

BACKGROUND OF THE INVENTION

The present invention relates to a guidance system for establishing a reference direction in space, and especially for directing the flight path of a vehicle such as an interceptor or other missile.

Guidance systems for this purpose have been known heretofore, but such systems have utilized inertial sensors such as gyroscopes to establish a reference direction, and have then guided the flight vehicle with reference to this established direction. Such systems require complex and delicate equipment and sophisticated computer systems, both on board the vehicle and at a remote ground station, and are undesirably complicated and expensive.

SUMMARY OF THE INVENTION

The present invention provides a guidance system utilizing laser commands to establish a reference direction in space for guiding a missile or other flight vehicle in the desired direction.

In accordance with the invention, the direction of the desired flight path for the vehicle is determined by a ground tracking station or other remote station. A first pulsed laser beam is fired in the direction of the flight vehicle and, upon receipt of a laser pulse on board the vehicle, an optical tracker is gated ON for a short period after a fixed, predetermined time delay. A second pulsed laser beam is fired in a direction to intersect the desired flight path at a set distance from the vehicle, and is controlled so that a pulse is fired after relative to the firing of a pulse of the first beam, and at a time such that backscattered energy from the segment of atmosphere illuminated by the second beam's pulse, as it crosses the desired flight path, reaches the tracker on the vehicle while it is gated ON. The tracker is thus irradiated by scattered energy from the second laser beam pulses's backscatter from the direction of the desired flight path. The desired direction in space is thus established, and the tracker causes the vehicle to fly in that direction. An accurate and relatively simple system is thus provided which requires no inertial sensors and which is resistant to outside interference.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
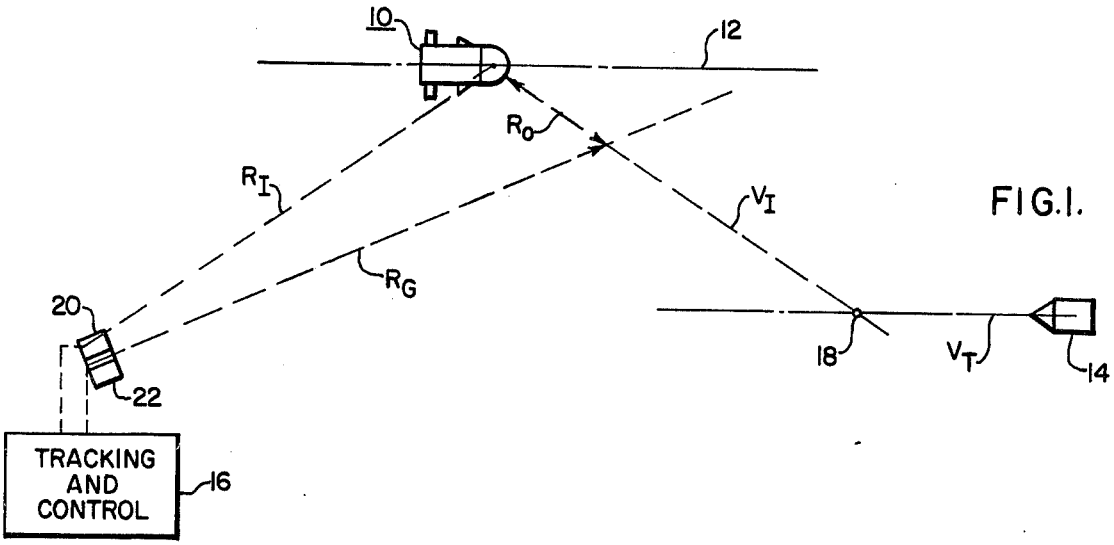
FIG. 1 is a schematic diagram illustrating the operation of the system.

As previously indicated, the present invention provides a system for establishing a reference direction in space and for causing a flight vehicle to follow the desired flight path. As shown schematically in FIG. 1, for example, a flight vehicle 10 which may be an unmanned interceptor, or a missile of any desired type, or any other flight vehicle, may be flying in a direction indicated at 12. It is assumed that a target indicated at 14 which may, for example, be an incoming cruise missile, or other target which it is desired to meet and destroy, is moving in the direction designated $V_T$. The purpose of the invention is to establish the desired flight path of the vehicle 10 and cause it to follow that path so as to intersect the flight path of the target 14. For this purpose, a remote tracking and control station 16 is provided. The station 16 may be a ground station or other remote station at any suitable location, and may be of any type which includes the necessary tracking equipment and computers. The station 16 has not been shown in detail since it may be of any known or suitable type to track the flight vehicle 10 and target 14 and to process the data as required. In this way, the remote station 16 tracks the vehicle 10 and target 14 and establishes a desired path indicated at $V_I$ for the vehicle 10 which would put it on a collision course with the target 14 to impact the target at a point 18.

In accordance with the present invention, the missile 10 is guided into the desired flight path $V_I$ by laser commands from a first or synchronizing laser 20 and a second or guiding laser 22. The lasers 20 and 22 may be of any suitable type capable of firing pulsed beams of relatively high energy, and they may be located at the remote station 16, or in any other desired location, and controlled from the station 16.

Figure 3:
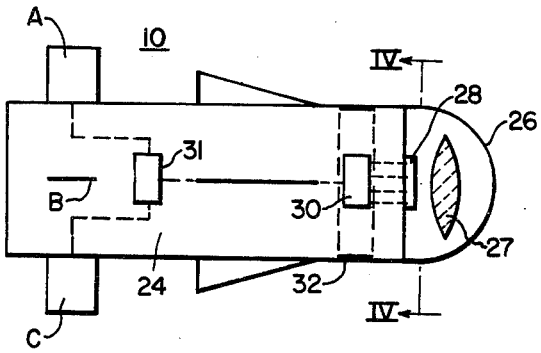
FIG. 3 is a diagrammatic view of a flight vehicle such as may be used in the system.
Figure 4:
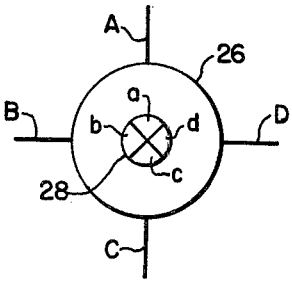
FIG. 4 is a transverse view substantially on the line IV—IV of FIG. 3.

The flight vehicle 10 itself may be any type of flight vehicle, either manned or unmanned, and is shown schematically in FIGS. 3 and 4 as an unmanned interceptor vehicle intended to destroy the target 14 upon impact. The vehicle 10 is shown as having a body 24 with stabilizing and control vanes A, B, C, and D, and may be of any desired configuration and type. The nose 26 of the flight vehicle 10 is shown as being generally semispherical and is transparent to radiation of the frequencies of the lasers 20 and 22. An optical tracker of any suitable type is carried on the vehicle 10. Such a tracker may include an optical system, represented by a lens 27, disposed in the nose 26 and adapted to focus incoming radiation on a quadrant detector 28. The detector 28 may be of any suitable type and preferably employs a standard silicon quadrant cell. Such a cell is divided into four quadrants a, b, c and d, as shown, and may be provided with a suitable control means generally indicated at 30. The control 30 may be of any known or suitable type capable of receiving laser pulses from the synchronizing laser 20 via aperture 32, and is adapted to control gating of the detector 28 to the ON state. The control 30 has a fixed time delay $T_R$ incorporated in it, and upon receipt of a laser pulse, the detector 28 is gated ON after the lapse of this predetermined time delay. This delay assures non-interference by the synchronizing laser if the quadrant detector is sensitive to its wavelength. The detector 28 remains ON for a brief time, as discussed hereinafter, and then reverts to the OFF state until another pulse is received. Signals from the several quadrants of the detector 28 are transmitted to the control 30, as indicated in FIG. 3, and from the control 30 to a mechanical control system 31, such as a servo system of any desired type, which actuates the stabilizing and control fins A, B, C and D, or other control means, to control the movement and flight direction of the vehicle 10, which maneuver the missile to re-center the received energy on the quadrants a, b, c and d.

The vehicle 10 is guided into the desired flight path $V_I$ in the manner illustrated diagrammatically in FIG. 1.

As previously mentioned, the remote station 16 tracks the vehicle 10 and the target 14 and establishes the flight path $V_I$. The remote station 16 also determines the direction and distance $R_I$ of the flight vehicle 10 from the synchronizing laser 20. The second or guiding laser 22 is intended to be fired in a direction so that its beam intersects the desired flight path $V_I$ at a distance $R_O$ from the vehicle 10. The distance $R_O$ may be selected to be any suitable distance and may, for example, be 5,000 meters if the distance ($R_G$) from the guiding laser 22 to the desired flight path is of the order of 5 to 10 kilometers. With the direction and distance $R_I$ known, and the distance $R_O$ and the direction of $V_I$ known, the resulting triangle can be solved to determine the required angle between the two laser beams and the distance and direction $R_G$ from the guiding laser 22 to the point of intersection with the desired flight path.

Figure 2:
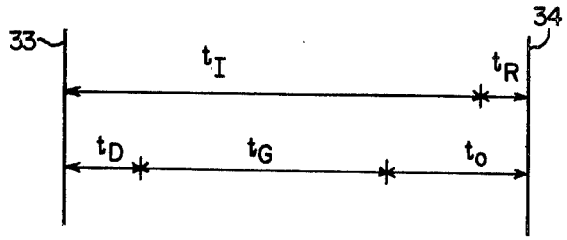
FIG. 2 is a diagram showing the relations of certain time periods.

Pulsed laser beams are then fired from the two lasers 20 and 22 in a manner indicated by the time diagram of FIG. 2. The line 33 in FIG. 2 indicates the time at which a pulse is fired by the synchronizing laser 20, while the line 34 indicates the time at which the backscattered pulse arrives at the missile receiver. The optical tracker on the flight vehicle 10 must be gated ON at the right time to be illuminated by backscattered energy from the guiding laser pulse as it crosses the path $V_I$. The synchronizing laser pulses reaches the vehicle 10 after a travel time $t_I = R_I/C$, where C is the velocity of light, and the tracker is gated ON by the laser pulse with a time delay $t_R$, as previously mentioned. The tracker is, therefore, gated ON at a time equal to $t_I$ plus $t_R$ after the laser 20 is fired. The guiding laser 22, therefore, must be fired with a time difference from when the laser 20 is fired such that $t_D$ plus the travel time $t_G = (R_G/C)$ plus $t_O = (R_O/C)$ will equal $t_I + t_{RI}$ the required time interval from 31 to 32. It will be seen from FIG. 2 that $$t_D = t_I + t_R - t_G - t_O$$

These times can readily be computed at the station 16 and the laser beams fired accordingly. Depending on the value of $t_R$ and $t_O$, $t_D$ may be of plus or minus value.

A pulse of the guiding laser beam thus crosses the desired flight path $V_I$ at the correct time to illuminate the tracker 28 by the scattered energy of the laser beam while the tracker is gated ON. The tracker remains ON, as previously mentioned, only for a brief time which is made equivalent to the length of the laser pulse, so that the tracker responds only to the scattered energy from the laser pulse at the precise time when it is crossing the desired flight path $V_I$. As previously described, the tracker 28 may comprise a quadrant-type detector, or other suitable type of detector which actuates control surfaces on the vehicle 10 to cause it to turn in the desired direction, that is, towards the laser pulse as seen by the tracker during the time it is gated ON, so that the vehicle 10 moves toward the point of intersection of the guiding laser beam with the desired flight path and thus is placed on the desired path. This process can, of course, be continuously repeated until the vehicle 10 reaches the target.

It will be seen that this guidance system requires no inertial sensing means such as gyroscopes, or other delicate instruments, and responds to the scattered light or energy from a laser pulse to cause the flight vehicle to turn in the direction of the pulse. It can readily be shown that with presently available equipment sufficient energy can be received in this way to cause the system to operate in the manner described. For example, assuming atmospheric visibility of 23.5 kilometers at the wavelengths of the laser beams utilized, with a 3 inch diameter receiver on the vehicle 10 of standard type, and assuming the distance $R_G$ to be 25 kilometers and $R_O$ to be set at 500 meters, a laser beam energy of 0.5 joule per pulse in the guiding laser beam will supply sufficient energy to cause operation of the tracker in the manner described by a laser pulse 15 meters long. At lower visibility such as 3 kilometers, and with a distance $R_G$ of 5 kilometers, representing extremely adverse atmospheric conditions, a minimum pulse length of 15 meters supplies sufficient scattered energy to make the system operate as described. These values are, of course, only illustrative and greater laser pulse energies would permit the use of even shorter pulses, while longer pulses would require less energy although with some loss of accuracy.

It will now be apparent that a command guidance system has been provided which utilizes known and existing types of equipment, and which does not require sensitive or delicate inertial sensors such as gyroscopes or unduly complicated systems. Since the tracker is gated ON only for extremely brief intervals, the system is not seriously affected by external influences, and is resistant to intentional interference such as electronic countermeasures. It will be apparent, therefore, that a very desirable but relatively simple system has been provided for establishing a reference direction in space.

What is claimed is:

1. A command guidance system for a flight vehicle having an optical tracker thereon, said system including remote means for determining a desired flight path for said vehicle, means for directing a first pulsed laser beam toward said vehicle to be received thereon, means for directing a second pulsed laser beam in a direction to intersect said desired flight path at a predetermined distance from the vehicle, said vehicle having means for gating said tracker ON in response to receipt of a pulse of said first laser beam after a time delay, and means for firing a pulse of said first laser beam and for firing a pulse of said second laser beam at a time thereafter such that the pulse of the second beam crosses said desired flight path at a time to irradiate said tracker while it is gated ON, the tracker having means for controlling the vehicle to cause it to fly toward the source of illumination.

2. A guidance system as defined in claim 1 in which said vehicle includes means for gating said tracker ON only for a time corresponding to the length of a pulse of the second laser beam.

3. A guidance system as defined in claim 2 including means for firing a pulse of the second laser beam at a time after firing a pulse of the first laser beam equal to the sum of the travel time of a pulse of the first beam to the vehicle and said time delay in gating the tracker minus the travel time of a pulse of the second beam to the desired flight path minus the time for the backscatter to return to the vehicle.

* * * * *